US009506312B2

(12) United States Patent
Williams et al.

(10) Patent No.: US 9,506,312 B2
(45) Date of Patent: Nov. 29, 2016

(54) BLOWOUT PREVENTER TEST JOINT ASSEMBLY, FOR TESTING VARIABLE BORE RAMS, SHEAR RAMS, AND ANNULARS

(71) Applicants: Brian Williams, Purvis, MS (US); Gregory LaFleur, Sulphur, LA (US)

(72) Inventors: Brian Williams, Purvis, MS (US); Gregory LaFleur, Sulphur, LA (US)

(73) Assignee: BACKOFF, LLC, Sulphur, LA (US)

( * ) Notice: Subject to any disclaimer, the term of this patent is extended or adjusted under 35 U.S.C. 154(b) by 0 days.

(21) Appl. No.: 14/613,089

(22) Filed: Feb. 3, 2015

(65) Prior Publication Data

US 2016/0222750 A1 Aug. 4, 2016

(51) Int. Cl.
*E21B 33/06* (2006.01)
*E21B 47/00* (2012.01)

(52) U.S. Cl.
CPC ..... *E21B 33/061* (2013.01); *E21B 47/00* (2013.01)

(58) Field of Classification Search
CPC .. E21B 47/1025; E21B 33/064; E21B 33/06; E21B 47/00
See application file for complete search history.

(56) References Cited

U.S. PATENT DOCUMENTS 2,951,363 A * 9/1960 Diodene ..... E21B 33/04 73/40.5 R
3,093,996 A * 6/1963 Jones ..... E21B 33/04 73/40.5 R
3,503,249 A 3/1970 Dumond
3,872,713 A * 3/1975 Ilfrey ..... E21B 33/043 73/152.57
3,897,824 A * 8/1975 Fisher ..... E21B 33/06 166/188
4,018,276 A * 4/1977 Bode ..... E21B 33/06 166/183
4,030,354 A * 6/1977 Scott ..... E21B 47/1025 73/152.01
4,090,395 A * 5/1978 Dixon ..... E21B 47/1025 166/250.08
4,152,924 A 5/1979 Mayo
4,347,733 A * 9/1982 Crain ..... E21B 47/1025 138/104
4,554,976 A * 11/1985 Hynes ..... E21B 17/06 166/337
4,559,809 A * 12/1985 Mayo ..... E21B 33/064 73/40.5 R
4,881,598 A * 11/1989 Stockinger ..... E21B 33/063 166/250.08
5,890,541 A * 4/1999 Jennings ..... E21B 33/064 166/250.08
6,032,736 A 3/2000 Williams
6,152,225 A 11/2000 Young et al.
6,390,194 B1 * 5/2002 Young ..... E21B 47/1025 166/250.08
7,062,960 B2 * 6/2006 Couren ..... E21B 33/061 73/152.51
7,647,973 B2 1/2010 Minassian
2003/0000693 A1 1/2003 Couren et al.
2013/0311093 A1 11/2013 Winters et al.

* cited by examiner

*Primary Examiner* — James G Sayre
(74) *Attorney, Agent, or Firm* — Keaty Law Firm LLC

(57) ABSTRACT

The invention discloses a test joint assembly for testing subsea BOP stack valves and annulars in one trip. The test joint assembly has an outer mandrel and a telescopically extendable inner mandrel. The inner mandrel seals against a bottom sub member using a bullnose sealing member.

22 Claims, 10 Drawing Sheets

BLOWOUT PREVENTER TEST JOINT ASSEMBLY, FOR TESTING VARIABLE BORE RAMS, SHEAR RAMS, AND ANNULARS

BACKGROUND OF THE INVENTION

This invention relates to high-pressure blowout preventer (BOP) testing in sub surface wells, and more particularly to a multi-gage blowout preventer test joint assembly for testing the variable bore rams against different OD pipe sizes, shear rams, and annular rams in one trip.

In conventional offshore drilling, a subsea wellhead is installed at the sea floor. A riser connects to the wellhead and extends upward to a drilling platform positioned above the water surface. A blowout preventer stack, hereinafter referred to as a BOP, is typically located within the riser.

In order to test the BOP, an operator closes the variable bore rams in the BOP on various diameter drill pipe and applies pressure between the well head plug and the particular variable bore rams being tested. A typical BOP stack contains rams having variable bore ram diameters, so as to engage with for instance 4½" OD and 6⅝" OD drill pipe. The BOP system must be capable of sealing off the annular space surrounding the drill pipe and same must be tested per the rig BOP procedure. It is preferred that the BOP test joint assembly be capable of testing the multi-gage pipe diameters in one downhole trip in order to save time and expense of multiple trips in and out of the hole.

One example of a multi-gage BOP test tool is shown in U.S. Pat. No. 6,032,736 issued on Mar. 2, 2000 to Terrell J. Williams. The multi-gage BOP test tool according to the '736 patent is designed to test different size ram and annular BOP's in one trip. The test tool according to that patent has an outer test tool assembly and an inner tube assembly connected in a telescoping relation. The exterior of the outer tube has a plurality of pipe gage diameters corresponding to different drill pipe sizes. A top sub at the top end of the outer tube assembly connects to the drill string and contains an upper seal assembly and stinger. The bottom end of the inner tube assembly is secured to a bottom sub and the bottom end of the outer tube assembly is releasably connected to the bottom sub in the collapsed position. The bottom sub is connected to a test plug and tail pipe assembly and the tool is lowered through the riser pipe and BOP stack to set the test plug in the wellhead. Ram and annular BOPs are tested against a first set of the pipe gage diameters with the tool in its collapsed condition, and then the outer tube assembly is uncoupled from the bottom sub and lifted to its extended position such that another set of the pipe gage diameters are positioned within the BOP stack and the rams and annular BOPs are then tested against the second axially positioned set of corresponding pipe gage diameters. The '736 patent uses a wireline retrievable dart that is dropped down the drill pipe and is held in position in the upper seal assembly. Drilling fluid flow bypasses the upper seal assembly through fluid passageways between the inner and outer tube assemblies and is vented through relief ports at the lower end of the tool.

While the test tool according to the '736 patent works satisfactorily in many environments, it was noted that the use of the wireline retrievable dart presents certain challenges, for instance a possibility that the dart becomes lodged in the well, which can cause loss of time in retrieving the dart. In the present invention, the wireline retrievable dart has been eliminated from the process. The present invention contemplates removal of drawbacks associated with the test tool and for providing a BOP test tool capable of testing different diameter pipes against rams in one trip into the well.

SUMMARY OF THE INVENTION

It is, therefore a primary objective of the present invention to provide a multi-gage BOP test tool capable of testing different size pipe diameters against: 1. variable bore rams, 2. shearable rams, and 3. annulars.

It is another object of the present invention to provide a stack specific multi-gage subsea BOP method for testing different size rams, shearable rams, and annular BOP's in one trip.

It is another object of the invention to provide a multi-gage BOP test tool for testing various diameter pipes against variable bore rams in a BOP stack without the need to employ a wireline retrievable dart.

Another object of the invention is that this tool can be customized as to the specific rig's testing requirements and can be configured to accommodate the testing of multiple diameter pipe sizes, rams, shearable rams and annular BOPs in one trip.

Further objectives and advantages of the present invention will become apparent from a careful reading of a detailed description provided herein, with appropriate reference to accompanying drawings. These and other objects of the invention will be easily recognizable to one of ordinary skill in the art.

These and other objects of the invention are achieved through a provision of a multi-gage blowout preventer test joint assembly for testing different size diameter pipe against variable bore rams and annular subsea blowout preventers in one trip into a wellbore. The test joint assembly comprises a tubular inner mandrel, a bottom sub member securable to a bottom end of the inner mandrel for connecting the inner mandrel to a wellhead sealing member, and a tubular outer mandrel telescopically and sealably receiving the inner mandrel in a surrounding relationship.

A tubular backoff sub member sealable and telescopically receives the internal mandrel. The backoff sub member has a lower end configured for threadable engagement with the bottom sub member and an upper part configured for threadable engagement with the outer mandrel. A rotation lug insert is mounted in a surrounding relationship over the internal mandrel, the rotation lug insert forms a lug engagement area between the rotation lug insert and the sealable internal mandrel for backing off the internal mandrel.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
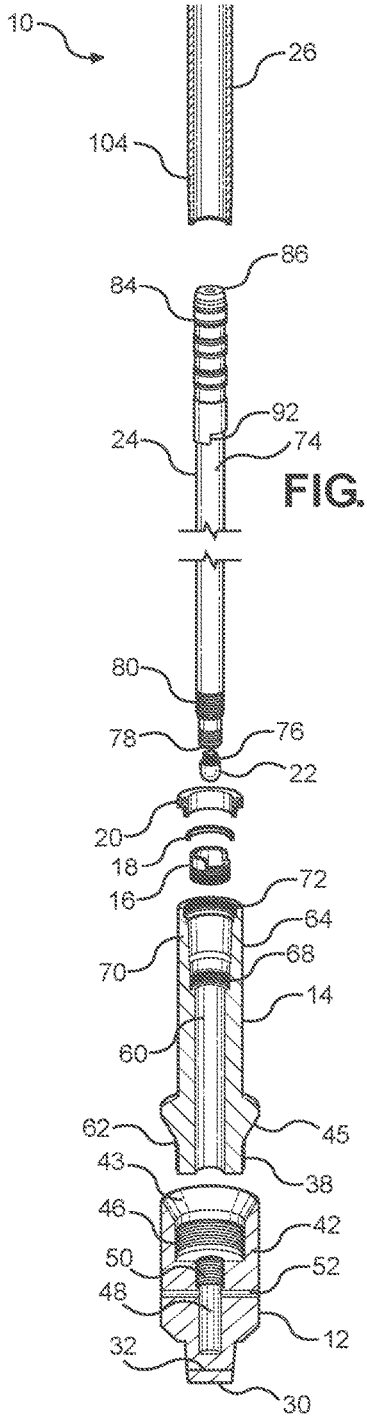
FIG. 1 is an exploded view of the test joint assembly according to the present invention.

Turning now to the drawings in more details, numeral 10 designates the test joint assembly according to the present invention. The test joint assembly 10 is designed to be employed in subsea locations, although onshore operations can benefit from the use of the test joint assembly 10 as well. The test joint assembly 10 comprises an elongated substantially cylindrical body comprised of several threadably engageable parts secured in a co-axial alignment: a bottom sub member 12, a backoff sub member 14, a rotation lug insert 16, a split ring 18, an anti-backoff ring member 20, a protective bullnose member 22, a tubular seal assembly mandrel (sometimes also referred to as an internal or inner mandrel) 24, and a tubular seal bore tube (sometimes referred to as an outer test tool or outer mandrel) 26. A tubular seal assembly mandrel (sometimes also referred to as an internal or inner mandrel) 24, and a tubular seal bore tube (sometimes referred to as an outer test tool or outer mandrel) 26 are sealable and telescopically engaged.

The bottom sub member 12 comprises a cylindrical body having a reduced diameter bottom portion 30 provided with exterior threads 32 for connection to a test plug (wellhead sealing member) 34 lowered into a wellbore 200 above a well casing 36. The test plug 34 is designed to be supported in the casing 36 a distance below a BOP stack 40. The threads 32 engage the test plug 34 during the BOP testing, as will be described in more detail hereinafter.

An upper portion 42 of the bottom sub member 12 is hollow; it is configured to threadably engage an externally threaded lower pin 38 of the backoff sub member 14. A right-handed acme connection 46 is formed in the interior of the upper portion 42 of the bottom sub 12 for engagement with the lower pin 38 of the backoff sub member 14. The interior of the upper portion 42 of the bottom sub member 12 has an outwardly flaring inner wall 43 configured to frictionally receive a lower end 45 of the backoff sub member 14, which has a matching exterior configuration to tightly fit into the "cup" formed by the outwardly flaring opening in the upper portion 42 of the bottom sub 12.

A reduced diameter opening 48 extends between the upper portion 42 and the bottom portion 30 of the bottom sub member 12. A left handed acme connection 50 is formed along the opening 48, and a bottom end of the seal assembly mandrel 24 is threadably engaged therewith during the variable bore ram BOP testing. A test weep hole 52 is formed in the upper portion 42 of the bottom sub 12. The weep hole 52 extends transversely to a normal longitudinal axis of the test joint assembly body. The weep hole 52 allows fluid to run out of the bottom sub 12 as the test joint assembly is pulled out of the well.

The backoff sub member 14 comprises a generally cylindrical body having a through opening 60 extending along the interior thereof. A seal 62 is provided on the exterior of the lower pin 38 of the backoff sub 14 above the exterior threads and below the lower end 45. An upper end 64 of the backoff sub 14 is provided with a series of vertically spaced inner thread sets: a first set 68 formed by left handed Acme connecting threads, a second set 70 formed by right handed connecting threads, and a third set 72 formed by left handed acme connecting threads.

Figure 2:
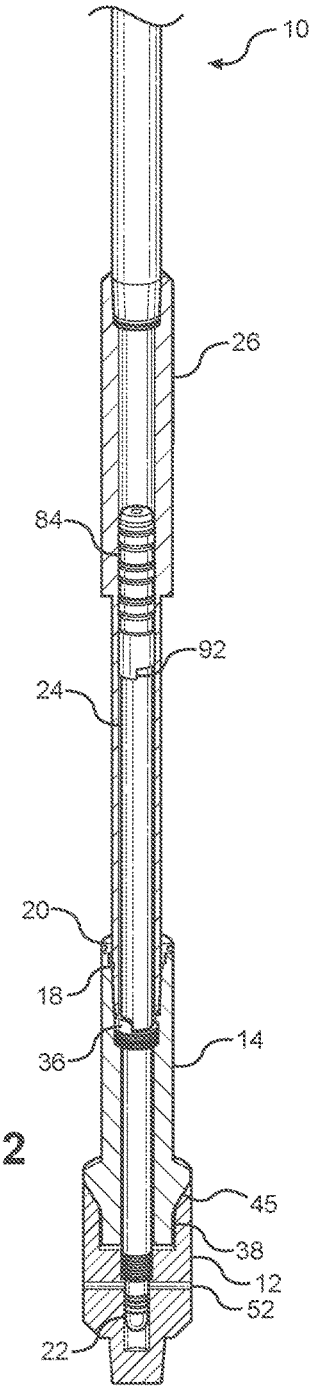
FIG. 2 illustrates the test joint assembly in a closed position.
Figure 10:
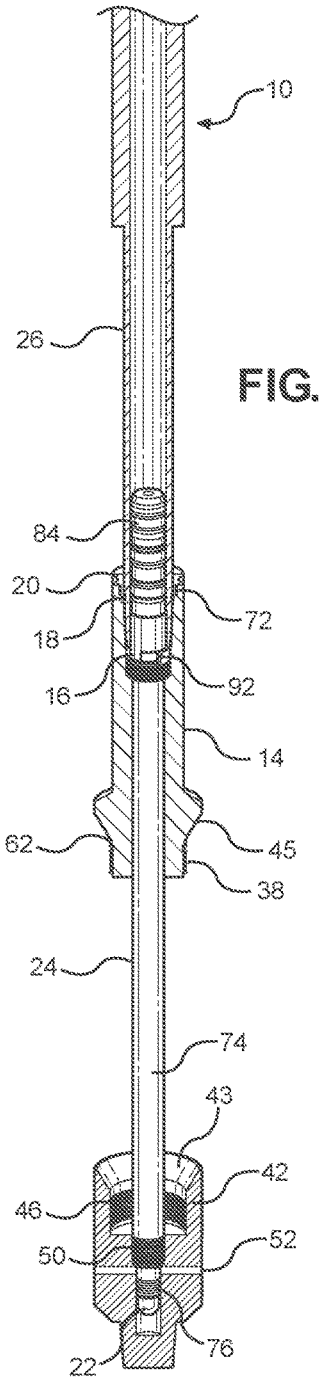
FIG. 10 illustrates the test joint assembly in the open engagement from the bottom sub.

The seal assembly mandrel (internal mandrel) 24 comprises an elongated cylindrical member having a through opening 74. A bottom end 76 of the internal mandrel 24 together with the bullnose member 22 forms a seal area for sealing the bore in the bottom sub 12 when the internal mandrel is engaged with bottom sub 12, as can be seen in FIG. 10. The bottom end 76 is provided with interior right handed acme connecting threads 78 configured to attach the bullnose member 22 to the bottom of the internal mandrel 24. The bullnose member 22 is provided with exterior threads that match the interior threads on the internal mandrel 24. In a closed position, when the seal assembly internal mandrel 24 is engaged with the bottom sub 12 (FIG. 2) the bullnose member 22 fits in the opening 48 below the weep hole 52.

A set of exterior left handed acme connecting threads 80 is provided on the seal assembly internal mandrel 24 a distance above the bottom end 76 of the seal assembly internal mandrel. The threads 80 match the threads 50 on the bottom sub 12 allowing the internal mandrel to be threadably engaged with the bottom sub 12.

Figure 3:
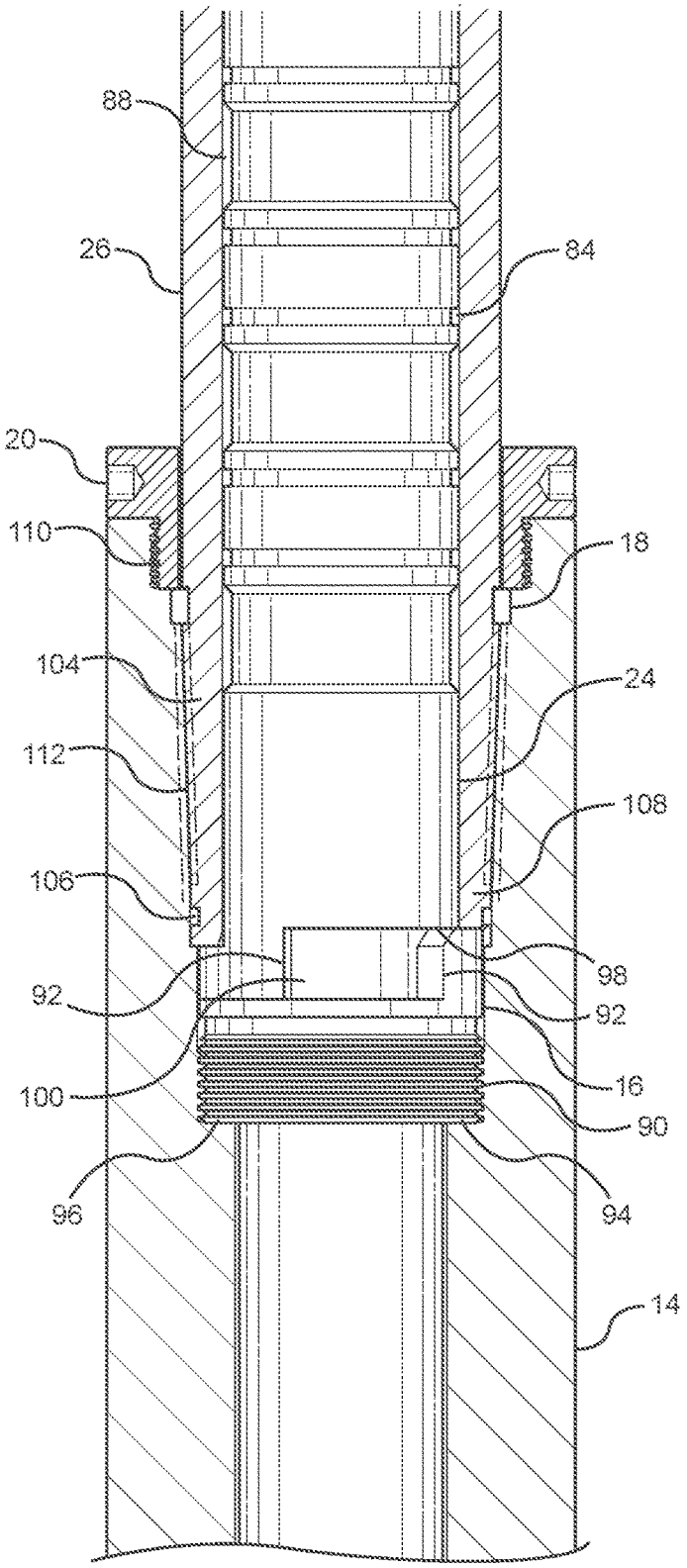
FIG. 3 is a detail view of the seal assembly mandrel in an open position.
Figure 4:
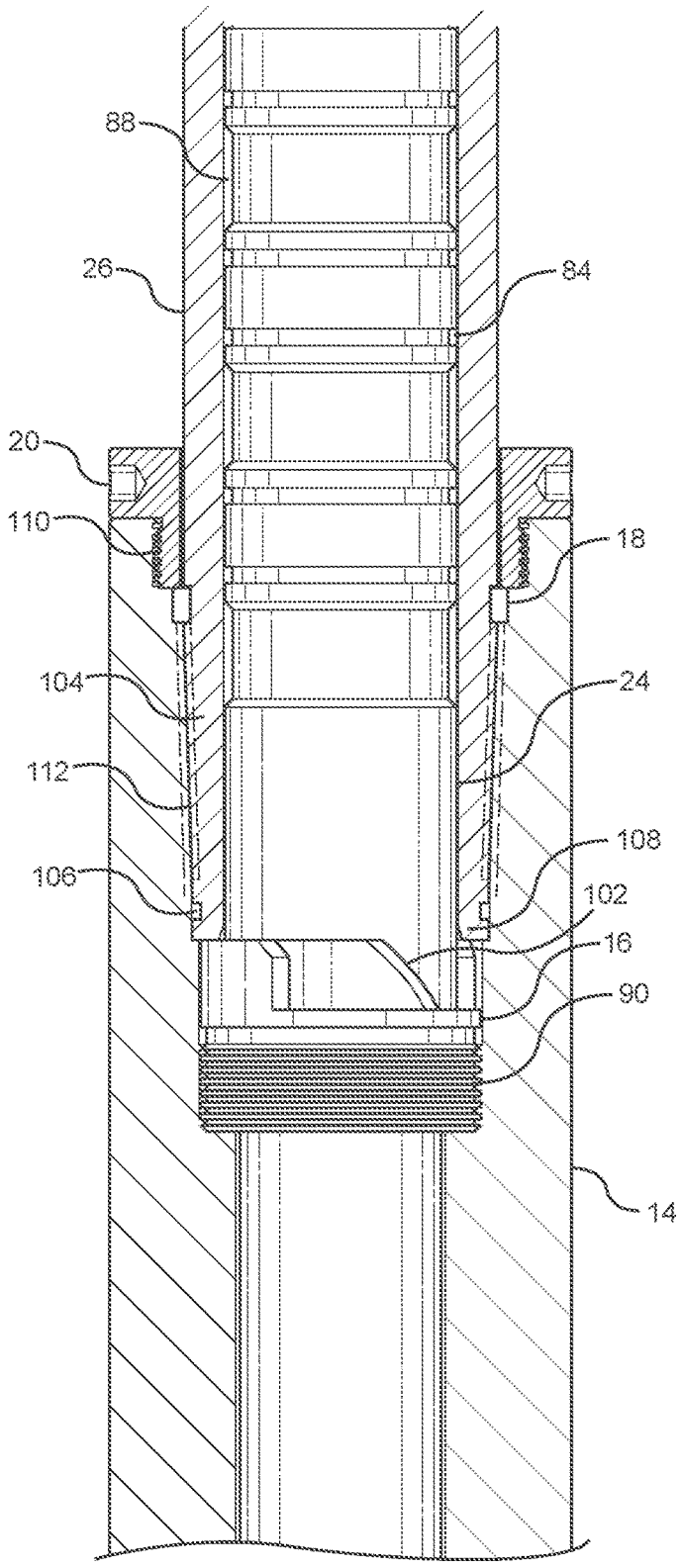
FIG. 4 is a detail view of the seal assembly mandrel in an open position with the test tool rotated 180 degrees in relation to the view of FIG. 3.

A plurality of vertically spaced seal grooves 84 is formed adjacent a top end 86 of the mandrel 24 to form a seal assembly of the mandrel. The seal grooves 84 are fitted with suitable sealing rings that seal against the inner wall 88 of the seal bore tube 26, as can be better seen in FIGS. 3 and 4.

The rotation lug insert 16 is mounted in a surrounding relationship over the internal mandrel 24. The rotation lug insert 16 has exterior left handed acme connecting threads 90 which match the inner threads 68 in the backoff sub 14. A lug engagement area 92 is formed between the rotation lug insert 16 and the internal mandrel 14 for backing of the mandrel 14. A bottom surface 94 of the lug insert 16 rests on a shoulder 96 formed on the interior wall of the backoff sub 14, while the upper surface 98 abuts a cutout 100 formed in the internal mandrel 24 (see, FIGS. 3 and 4).

The cutout 100 has an angled wall 102, which prevents engagement of the lug insert when the mandrel 24 is rotated to the left, while allowing engagement with the mandrel during a right-hand rotation of the mandrel when backing the mandrel off. The lug insert 16 engages in one direction only as a result of the angle placed on the internal mandrel 14. The angled lug on the internal mandrel engages the rotation lug insert 16 so that the pin tube is pushed down as a result of the angle on the mandrel pushing it down.

A lower section 104 of the seal bore tube (outer mandrel) 26 fits into the central opening of the backoff sub 14 in a surrounding relationship to the seal assembly mandrel 24. A seal groove 106 is formed in a pin 108 of the lower section 104, and a suitable sealing member is positioned therein to seal the pin 108. The pin 108 rests on the upper surface of the lug insert 16.

The split ring 18 is fitted between the exterior of the seal bore tube 26 and the backoff sub 14. The anti-backoff ring 20 is threadably engaged to the backoff sub 24 using left-handed acme threads 110. The anti-backoff ring 20 has a central opening allowing the anti-backoff ring to fit in a surrounding relationship over a segment of the seal bore tube 26 above the split ring 18. Right-handed connection thread 112 extends longitudinally along the lower section 104 below the split ring 18 for mating with the threads 70 of the backoff sub 14. The outer mandrel 26 carries one or more centralizer sub members 120.

Figure 5:
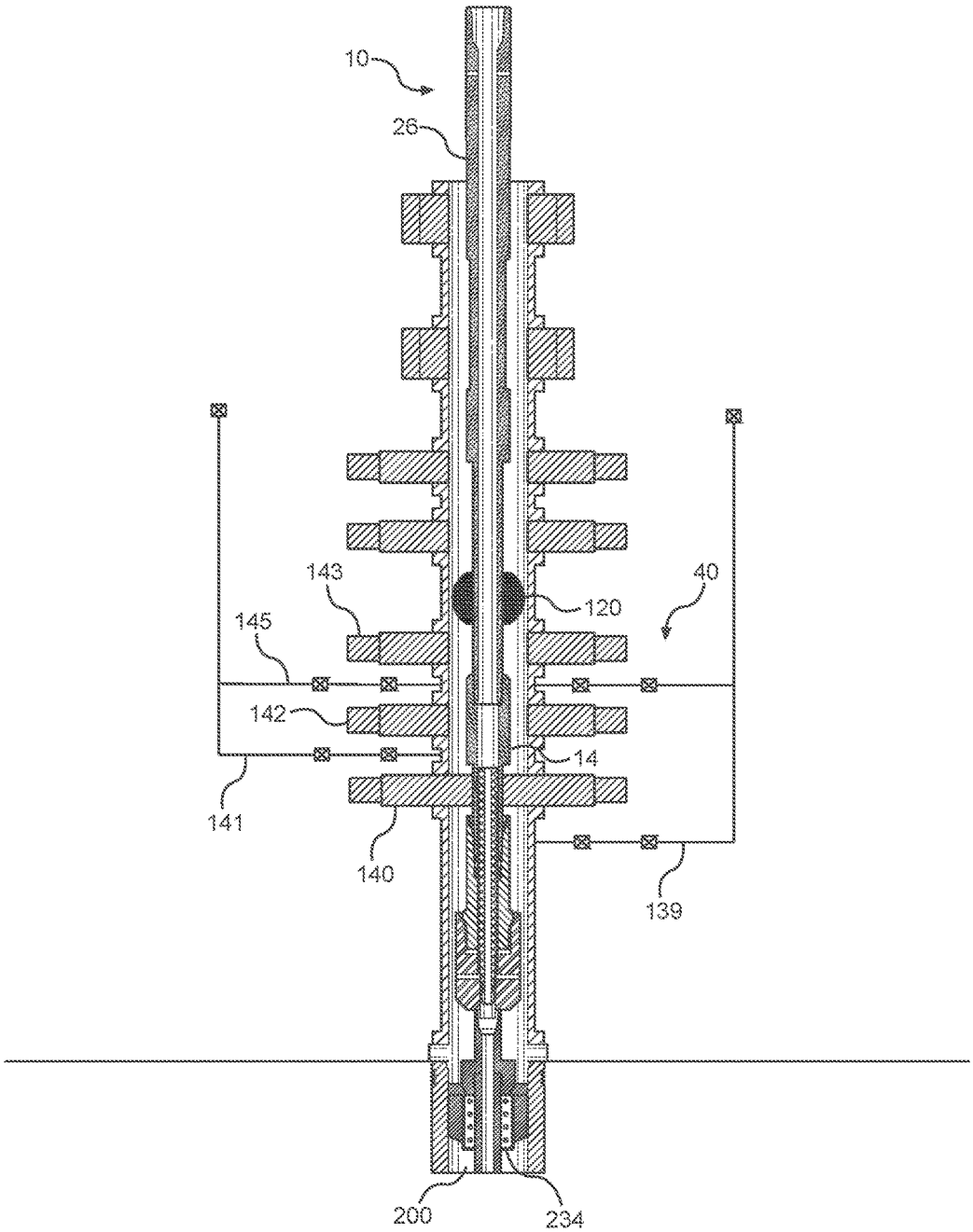
FIG. 5 is a schematic, partially cross-sectional view of the test joint assembly in a closed position during a BOP ram test on a small OD of the test joint.
Figure 6:
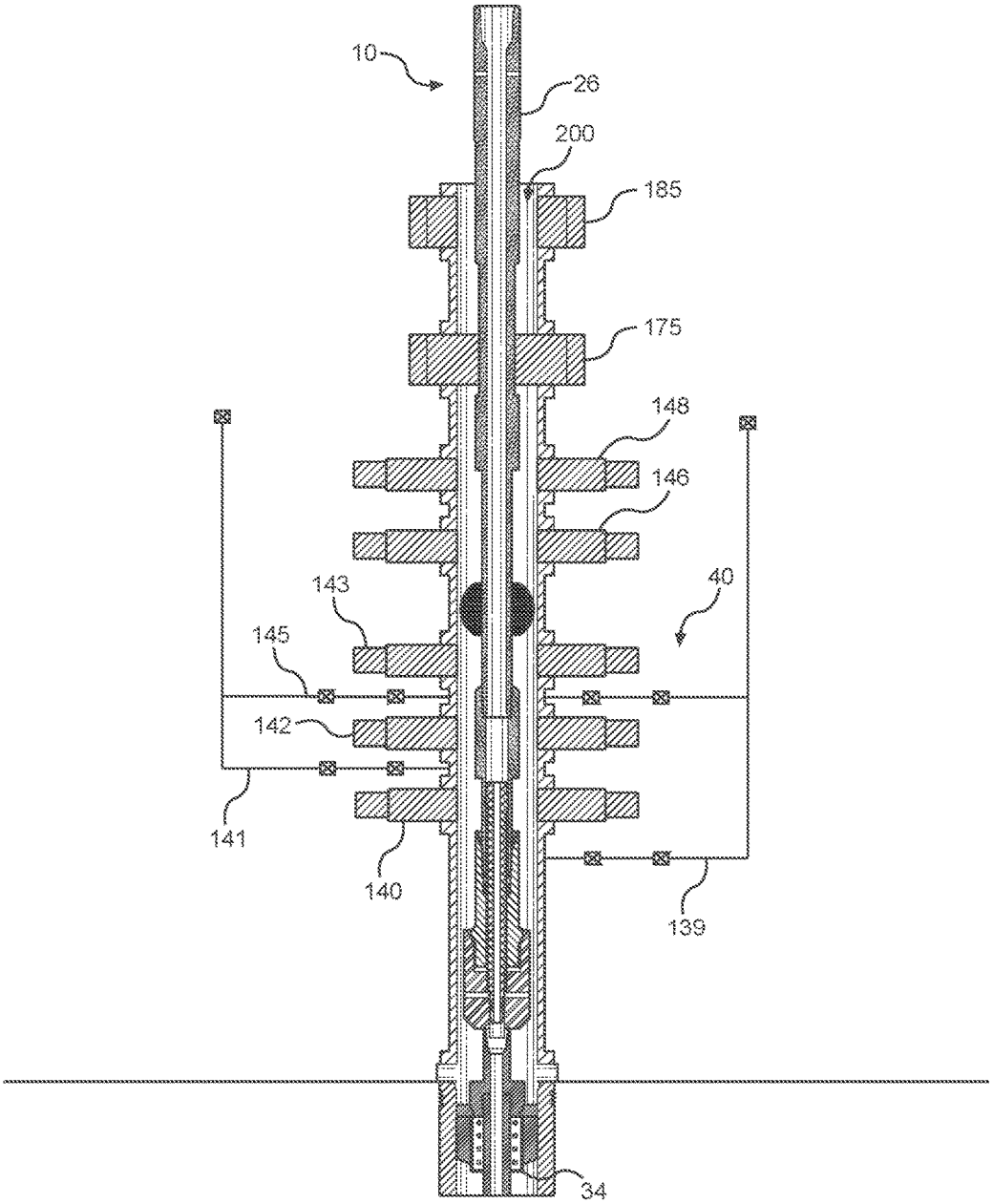
FIG. 6 is a schematic, partially cross-sectional view of the test joint assembly in a closed position during an annular test on a small OD of the test joint.
Figure 7:
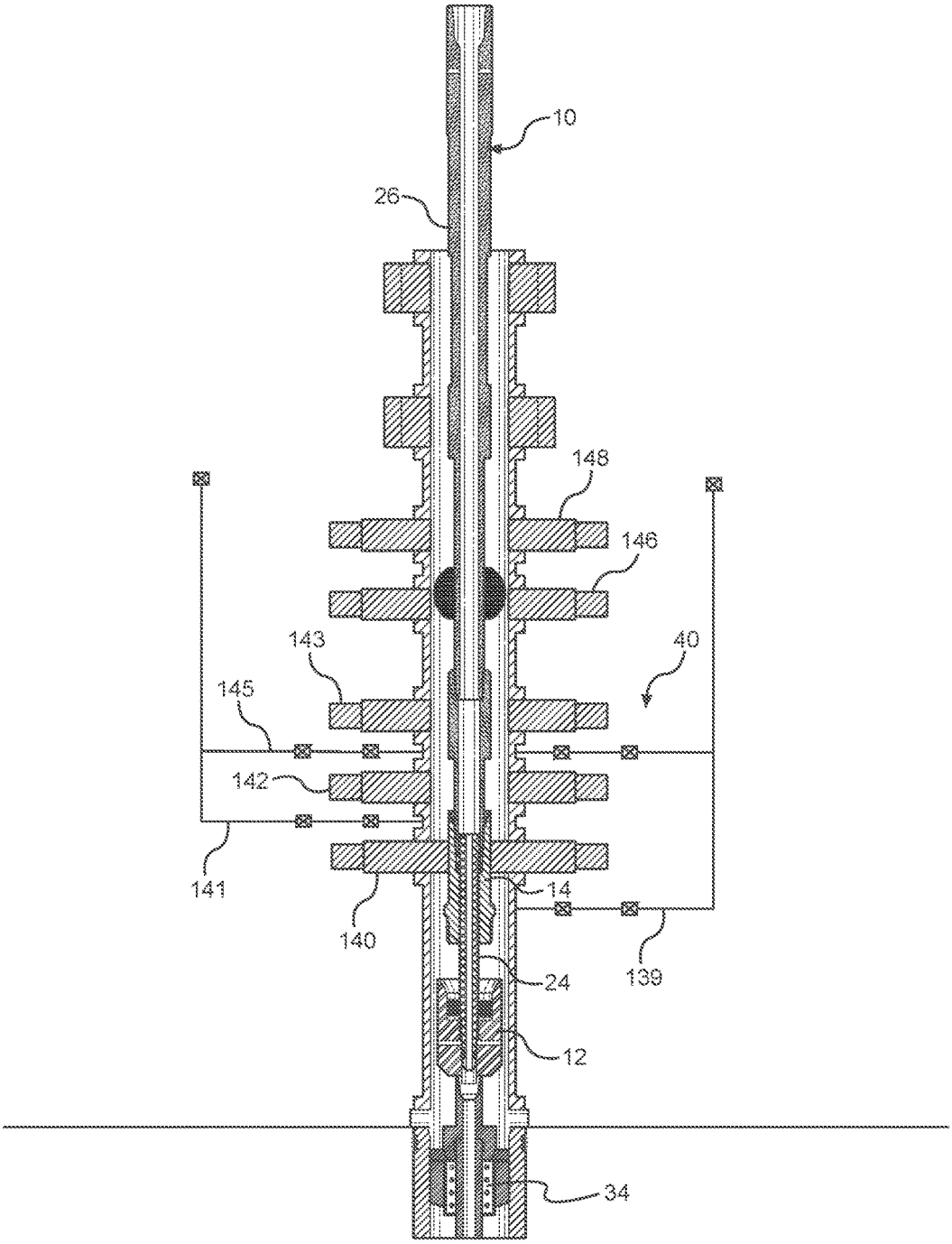
FIG. 7 is a schematic, partially cross-sectional view of the test joint assembly in an open position during a BOP ram test on a large OD of the test joint.
Figure 8:
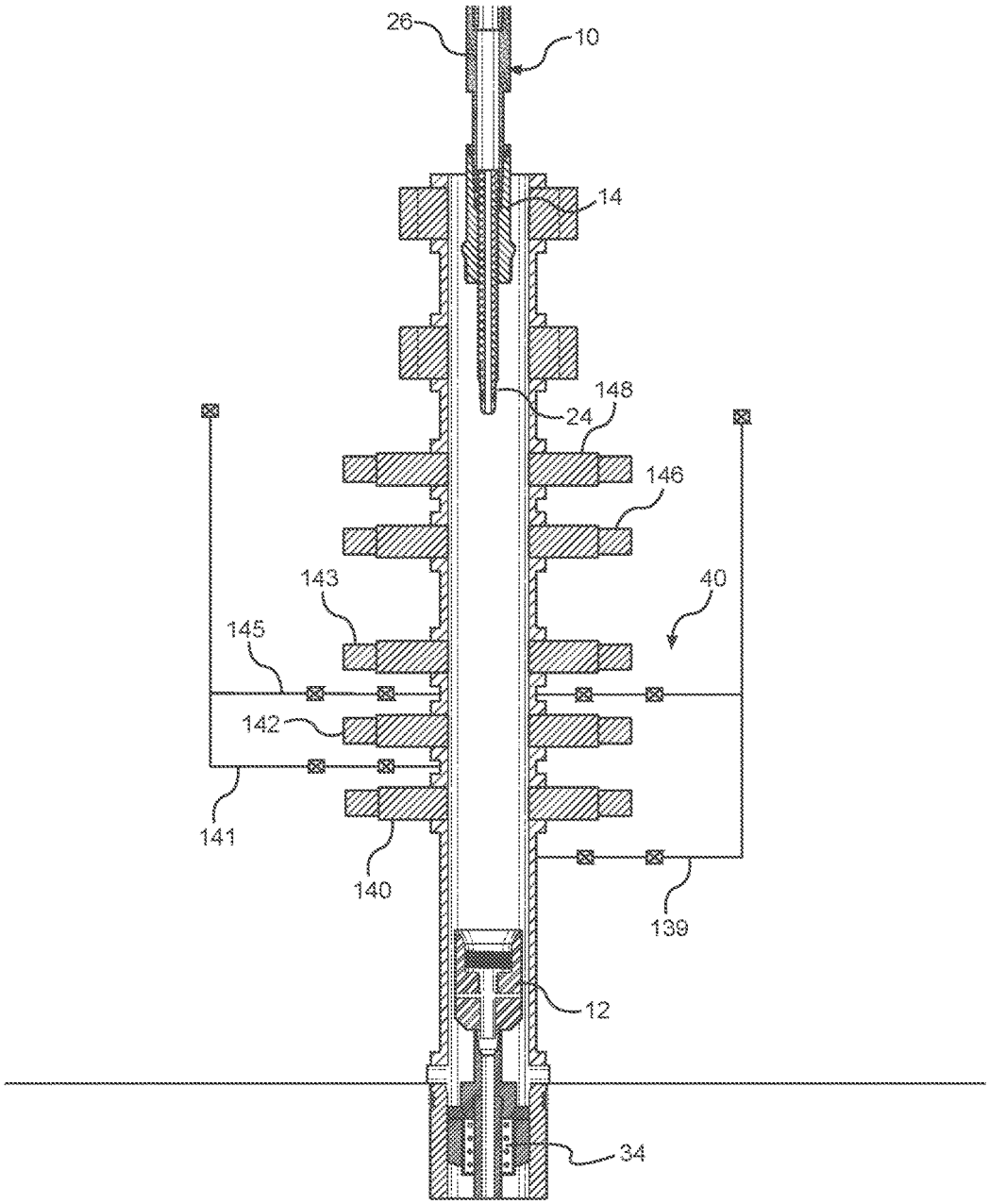
FIG. 8 is a schematic, partially cross-sectional view of the test joint assembly in a blind/shear test position.
Figure 9:
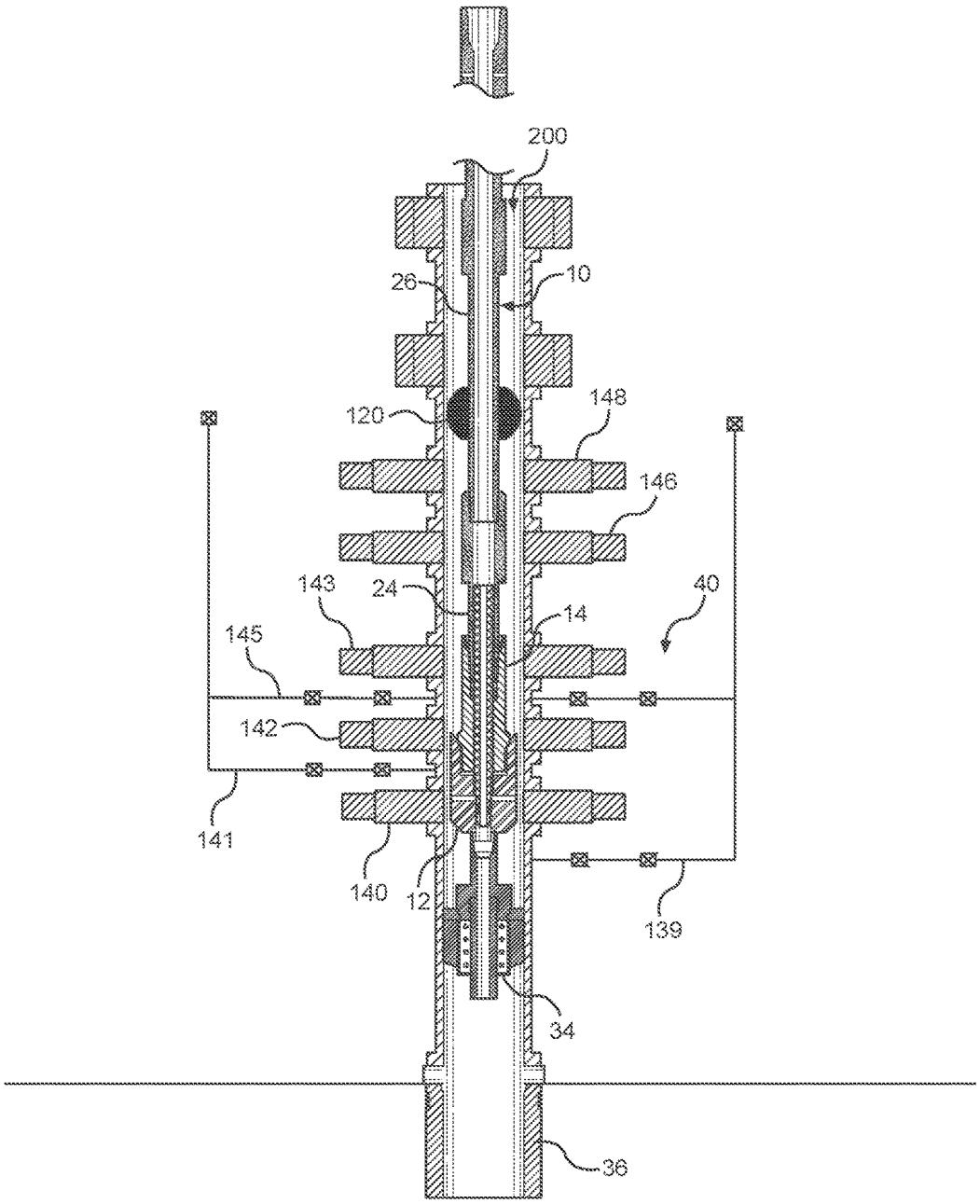
FIG. 9 is a schematic, partially cross-sectional view of mud draining after the test joint assembly and test plug has been retrieved.

FIG. 5 illustrates a closed position of the test joint assembly, with the test fluid admitted below the lower ram 140. FIG. 6 illustrates a closed position of the joint assembly during an annular 175 test, with the test fluid admitted above the test plug 34 and annular 175. FIG. 7 illustrates the open position during the test procedure, with the internal mandrel 24 telescopically extended from the outer mandrel and through the backoff sub member 14. FIG. 8 illustrates the blind/shear test position, with the internal mandrel 24 lifted from its sealing engagement with the bottom sub member 12. FIG. 9 illustrates a step of mud draining as the test tool is retrieved.

FIG. 10 illustrates the internal mandrel 24 being threadably engaged with the bottom sub 12 and prevented from right-hand rotation. The rotation lug insert 16 in the lug engagement area 92 catches the shoulder of the internal mandrel 24, while the backoff sub 14 threads into the bottom sub 12. During operation, the test joint assembly 10 in a collapsed (closed) position is lowered into a well 200; then the bottom sub 12 is turned until the backoff sub 14 is threadably disengaged from the bottom sub and the tool is raised from the drill floor a pre-determined distance according to the depth of the BOP stack location. In one exemplary embodiment, the test joint assembly is raised 29.92". During this step, the internal mandrel 24 does not turn and the backoff sub 16 is raised with the outer mandrel 16 not being able to go any further since its movement is limited by the shoulder at the rotation lug insert 16.

Figure 11:
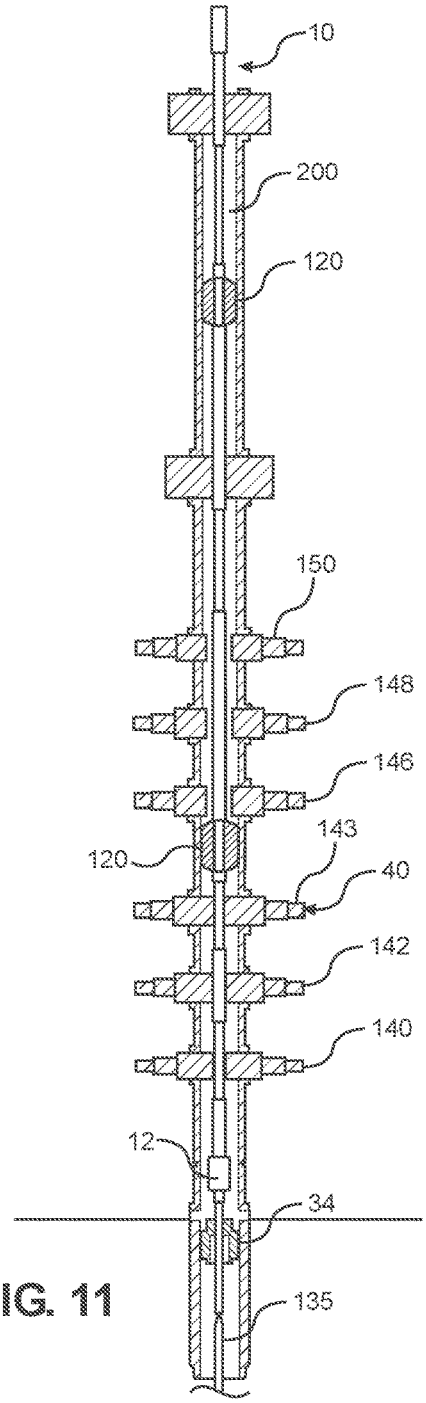
FIG. 11 schematically illustrates the test joint assembly engaged with the test plug in a closed position when testing different OD pipe against the variable bore rams and testing the annulars against different ODs.

FIG. 11 illustrates the use of the test joint assembly 10 when testing the lower rams of the BOP stack. The lower rams are variable diameter rams are to be tested on the various diameters of pipes that could possibly be in the hole when a blowout occurs. Hence the variable diameter rams need to be tested on the specific diameters present on the particular rig. In the example shown in FIGS. 11-13, the lower rams 140, 142, 143 with the test tool in the closed position, are able to be tested against 6⅝" OD, 4½" OD and 6⅝" OD respectively. The shear rams positioned above the BOP stack 40 are designated by numerals 146, 148 and 150. Various choke or kill lines 141, 145 are connected to the BOP stack 40 for testing the variable bore rams ability to hold pressure in the wellbore 200 depending on the stack specific OD pipe that may be in the bore.

In the test joint assembly 10, the seal bore tube (outer mandrel) 26 and the backoff sub 14 form a continuous unit telescopically receiving the internal mandrel 24 in the coaxially aligned central openings. Once the test joint assembly is set in the wellbore 200 and the test plug 34 is set, the first series of tests on the various diameter BOP stack rams can begin. The next step is to cause the backoff sub 14 to rotate and undo the threaded engagement with the bottom sub 12. At this point the bottom sub 12, which is connected to the seal bore tube (outer mandrel) 26 can be raised the 29.92" putting the different diameters in the face of the variable diameter rams in the BOP stack 40, and the variable bore rams can be tested against the stack specific ODs.

The next step is to turn the internal mandrel 24 by using the lug on the internal mandrel 24 so that the internal mandrel 24 is unscrewed from the bottom sub 12, allowing the entire string except for the bottom sub 12 to be raised so as to clear the shear rams for testing the shear rams. The test joint assembly is raised approximately 30' or as specified by the rig test procedure so as to clear the shear rams 146, 148, and 150. The shear rams 146, 148, 150 are then tested.

Once the shear rams are tested and the shear rams are fully opened, the entire string with the test joint assembly 10 can be lowered down so that the internal mandrel 24 comes into contact with the bottom sub 12 so as to be threadably engaged. When the bottom sub 12 and the backoff sub 14 are threaded together the entire test joint assembly including the test plug 34 and tail pipe 135 are removed from the wellbore 200. The test of the BOP stack variable bore rams, annulars and the shear rams is now complete.

Generally, the only rotation imparted from the surface on the test joint assembly 10 is to unscrew the backoff sub 14 from the bottom sub 12 and raise the tool 29.92" at which point the internal mandrel 24 comes into contact with the lugs at the top of the lug insert 16. Then and only then the lugs can be used to unscrew the internal mandrel 24 from the bottom sub 12 and raise the whole string up so that the shear rams can be tested. At the final step, lowering the test joint assembly 10 and applying torque from the surface so that the backoff sub 16 can be threadably engaged again with the bottom sub 12. Because of the structure of the lugs on the internal mandrel 24 prevents threaded engagement of the internal mandrel with the bottom sub 12.

Once the test on a particular BOP stack and shear rams are complete the test joint assembly 10 is returned to the shop and is prepared for a new test. At that point the internal mandrel 24 is screwed into the bottom sub 12 and the proper torque is put on to the various connections so as to ensure backoff sub 14 unscrews from the bottom sub 12. To minimize the danger of the bottom sub 12 separating from the test plug it is made up with the chain tongs at the surface for high torque.

A more detailed operating procedure is presented herewith:

Raise the test joint assembly 10 with the rig crane and place in the "V" door. Latch onto the test joint assembly 10 with the derrick elevators and pick up in the derrick structure.

Couple at least 25,000 LBS of drill pipe 36 for weight below the test plug 34 to hold it in place. Make up the test plug 34 on the tail pipe 135, and the test joint assembly 10 on the test plug 34. The coupled tail pipe 135 is downhole below the test plug 34 and the tool 10 is positioned above the test plug 34.

Inspect and verify to be sure that the right hand acme threads 38 between the bottom sub 12 and the lower end of the backoff sub 14 are made up; seven (7) right-hand turns between threads 38 and threads 45 are required to make up. Make up chain tong tight only. Do not over torque as this joint will be unscrewed further along in the operation procedure. Lower the test joint assembly 10 through the rotary and set the slips.

Make up the drill pipe and run in hole with the tail pipe 135, test plug 34, and the test joint assembly 10. Set the test plug 34 in the well head.

Next in the operation procedure, the following tests are to be performed: The lower variable bore ram 140 on the small diameter pipe of the BOP, the middle variable bore ram 142 is to be tested against the larger diameter pipe BOP and the upper variable bore ram 143 to be tested on the smaller diameter pipe inside the BOP as well as the lower annular 175 to be tested on the small diameter pipe inside the BOP, and the upper annular 185 to be tested against the large diameter pipe inside the BOP. All of the tests are to be performed while the test joint assembly 10 is in its closed position. The testing pressures are per the rig test procedure.

Subsequent to the above tests being complete, open all variable bore rams and annulars, the shear rams are already open. Rotate the drill pipe at the surface so as to unscrew or release the backoff sub 14 from the bottom sub 12 at threads 38 and 46 respectively. Seven (7) left hand turns at the rig floor are required to release backoff sub 14 from the bottom sub 12.

The variable bore rams 140, 142, 143 and annulars in the BOP stack 40 are stack specific to two different size pipes. In the event that the pipe diameter in a particular well change, the variable bore ram diameter may change depending on the pipe diameter that are used in a particular well. The test joint assembly 10 is made stack specific but can be easily adapted to various size rams and annulars by changing the diameter of the mandrels and subs.

Engage the motion compensator on the rig floor at the surface and pick up the test joint assembly 10 a total of 29.92 inches until the lug engagement area 92 for backing off the seal assembly mandrel 24 comes into contact with the rotation lug insert 16. The drill pipe above the test joint assembly 10 and the seal bore tube 26 of the test joint assembly 10 will move upward. The tail pipe 135, test plug 34, and the seal assembly mandrel 24 will remain stationary. The seal assembly mandrel 24 is stationary in that it is threadably engaged to the bottom sub 14 at left hand acme connection 50. The pick up weight will be less the weight of the tail pipe 135, test plug 34 and seal assembly mandrel 24. The lug engagement area 92 for backing off the seal assembly mandrel 24 and seal bore tube 26 will make contact when fully extended. Only pick up high enough to make contact with the lug engagement area 92 for backing off the seal assembly mandrel 24 and rotation lug insert 16. Do not pick up higher than necessary or the test plug 34 may be unseated.

Now in the operation procedure, the following tests are to be performed: The lower variable bore ram 140 on the large diameter pipe of the BOP, the middle variable bore ram 142 is to be tested against the small diameter pipe BOP and the upper variable bore ram 143 to be tested on the large diameter pipe inside the BOP as well as the lower annular to be tested on the large diameter pipe inside the BOP, and the upper annular to be tested against the small diameter pipe inside the BOP. All of the tests are to be performed while the test joint assembly 10 is in its open position.

Once the above tests are complete, open all rams and annulars. Rotate the drill pipe to the right to release the seal assembly mandrel 24 from the bottom sub 12. Seven (7) right hand turns at the surface are required to release the seal assembly mandrel 24 from its threaded location 50 internal to the bottom sub 12.

Engage the motion compensator once again and pick up a minimum of 30 feet, so the backoff sub 14 and seal assembly mandrel 24 clears all of the blind/shear rams as seen FIG. 5. The drill pipe, seal bore tube 26 of the test joint assembly 10 moves upward, at least 30 feet.

Figure 12:
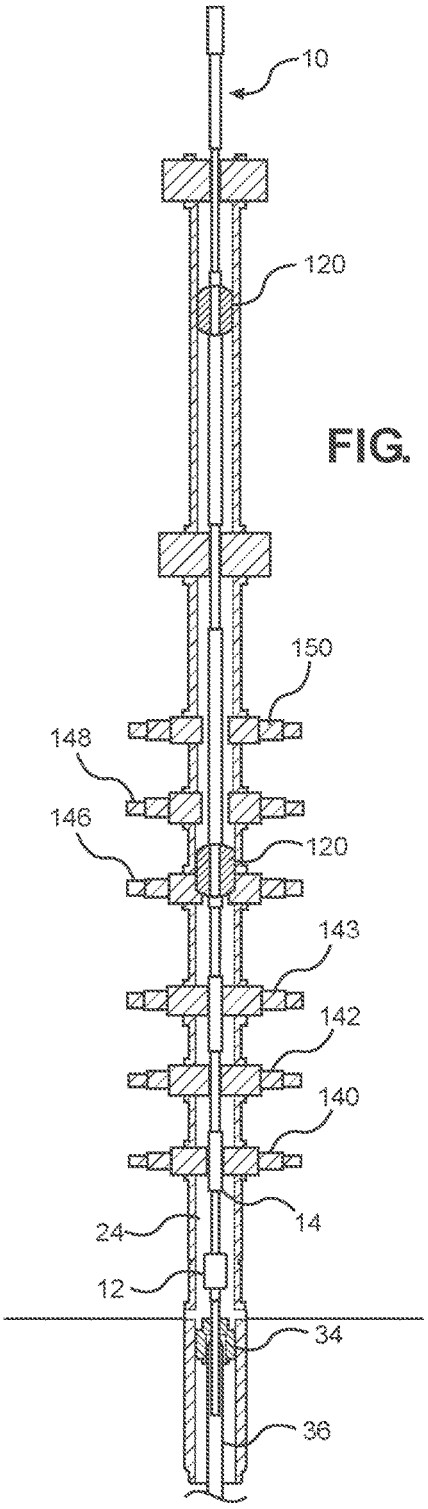
FIG. 12 schematically illustrates the test joint assembly engaged with the test plug in an open position when testing different OD pipe against the variable bore rams and testing the annulars against different ODs.
Figure 13:
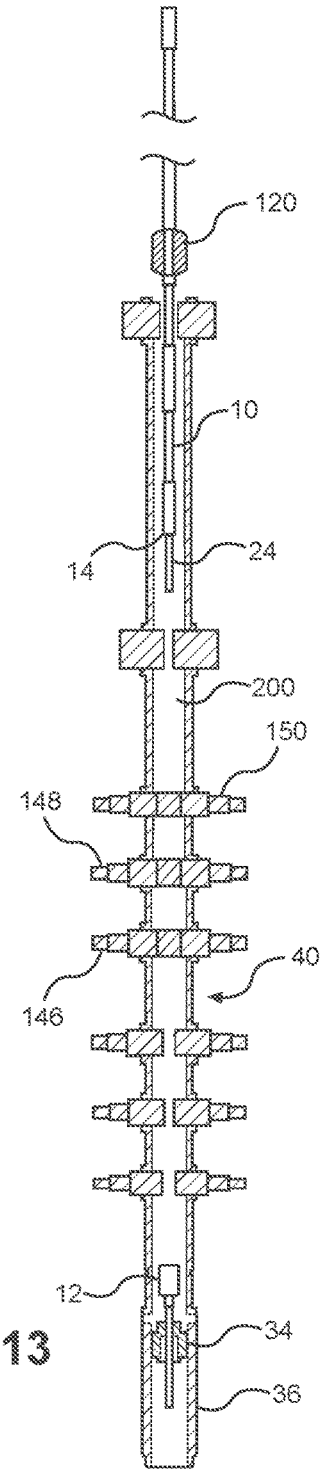
FIG. 13 schematically illustrates the test joint assembly during a blind/shear test after the test joint assembly has been lifted from the BOP stack.

Ensure that the assembly is raised far enough to clear all of the blind/shear rams 146, 148 and 150 as seen in FIGS. 11, 12, and 13 before proceeding. The test plug 34 stays in place so that rams can be tested. Be sure to check clearance on all blind/shear rams 146, 148 and 150 as seen in FIGS. 11, 12, and 13 before proceeding. The test joint assembly 10 is shearable in the event of a blow out during testing.

Close the blind/shear rams 146, 148 and 150 as seen in FIGS. 11, 12, and 13 and perform testing as per the rig test procedure.

Upon completion of the blind/shear rams tests and all of the blind/shear rams are fully open, slowly lower the seal bore assembly 26 which is internal to backoff sub 14 and rigidly connected thereto until it comes into contact with the threaded area right handed acme connection 46 located in the top of bottom sub 12. The seal assembly mandrel 24 does not become threadably engaged into the bottom sub 12 at this point. The test joint assembly 10 will begin to stroke closed. Continue slowly lowering the seal bore tube 26 and backoff sub 14 until the externally threaded right hand acme pin 38 makes contact with the right-handed acme connection 46 on the internal top portion of bottom sub 12. Pick up slightly on test joint assembly 10 and begin slightly rotating the drill pipe to the right to aid in making the threaded connection between 38 and 46. While continuing to slowly rotate to the right, slowly lower the drill pipe and then make up the right-hand acme connection 38 and 46 of the backoff sub 14 and the bottom sub 12, respectively. Rotate until torque is gained.

Pull out of the hole with the drill pipe, test joint assembly 10, test plug 34 and the tail pipe 135. Set the test plug 34 in the rotary table and remove tool 10 and lay down. At this point, the tool must be redressed and cleaned before retesting.

Many changes and modifications can be made in the test joint assembly of the present invention without departing from the spirit thereof. I, therefore, pray that my rights to the present invention be limited only by the scope of the appended claims.

We claim:

1. A multi-gage blowout preventer test joint assembly for testing different size ram and annular subsea blowout preventers in one trip into a wellbore, comprising:

a tubular inner mandrel;

a bottom sub member securable to a bottom end of the inner mandrel for connecting the inner mandrel to a wellhead sealing member;

a tubular outer mandrel telescopically receiving the inner mandrel in a surrounding relationship;

a tubular backoff sub member having a lower end configured for threadable engagement with the bottom sub member and an upper part configured for threadable engagement with the outer mandrel, wherein the backoff sub member is provided with an internal shoulder and wherein a bottom surface of the rotation lug insert rests on said internal shoulder; and a rotation lug insert mounted in a surrounding relationship over the internal mandrel, the rotation lug insert forms a lug engagement area between the rotation lug insert and the internal mandrel for backing off the internal mandrel.

2. The assembly of claim 1, wherein the internal mandrel is provided with a lug cutout, and wherein an upper surface of the rotation lug insert abuts said cutout.

3. The assembly of claim 2, wherein the lug cutout has an angled aspect preventing engagement of the rotation lug insert when the internal mandrel is rotated to the left, while allowing engagement of the rotation lug insert with the internal mandrel during a right-hand rotation of the internal mandrel when the internal mandrel is backed off.

4. A multi-gage blowout preventer test joint assembly for testing different size ram and annular subsea blowout preventers in one trip into a wellbore, comprising:

a tubular inner mandrel;

a bottom sub member securable to a bottom end of the inner mandrel for connecting the inner mandrel to a wellhead sealing member;

a tubular outer mandrel telescopically receiving the inner mandrel in a surrounding relationship;

a tubular backoff sub member having a lower end configured for threadable engagement with the bottom sub member and an upper part configured for threadable engagement with the outer mandrel, wherein the bottom sub member comprises a hollow upper portion with internal threads, said upper portion being configured to threadably engage an externally threaded lower end of the backoff sub member; and a rotation lug insert mounted in a surrounding relationship over the internal mandrel, the rotation lug insert forms a lug engagement area between the rotation lug insert and the internal mandrel for backing off the internal mandrel.

5. The assembly of claim 4, the bottom sub member comprising a reduced diameter opening formed below the upper portion.

6. The assembly of claim 5, comprising a bullnose member detachably engageable with a bottom of the internal mandrel and configured to seal the reduced diameter opening when the internal mandrel is engaged with bottom sub member.

7. The assembly of claim 6, wherein the reduced diameter opening is provided with internal threads along at least a portion thereof, and wherein the internal mandrel is threadably engaged therewith during a blowout preventer testing procedure.

8. The assembly of claim 7, wherein a test weep hole is formed in the upper portion of the bottom sub member, the weep hole extending transversely to a longitudinal axis of the bottom sub member, the weep hole allowing test fluid to run out of the bottom sub member as the test joint assembly is pulled out of the wellbore.

9. The assembly of claim 4, wherein the upper portion of the bottom sub member has an outwardly flaring inner wall configured to frictionally receive the lower end of the backoff sub member.

10. A multi-gage blowout preventer test joint assembly for testing different size ram and annular subsea blowout preventers in one trip into a wellbore, comprising:

a tubular inner mandrel;

a bottom sub member securable to a bottom end of the inner mandrel for connecting the inner mandrel to a wellhead sealing member;

a tubular outer mandrel telescopically receiving the inner mandrel in a surrounding relationship;

a tubular backoff sub member having a lower end configured for threadable engagement with the bottom sub member and an upper part configured for threadable engagement with the outer mandrel;

a rotation lug insert mounted in a surrounding relationship over the internal mandrel, the rotation lug insert forms a lug engagement area between the rotation lug insert and the internal mandrel for backing off the internal mandrel; and a split ring fitted between an exterior of the outer mandrel and the backoff sub member and an anti-backoff ring positioned in a surrounding relationship over a segment of the outer mandrel above the split ring.

11. A multi-gage blowout preventer test joint assembly for testing different size ram and annular subsea blowout preventers in one trip into a wellbore, comprising:

a tubular inner mandrel;

a bottom sub member securable to a bottom end of the inner mandrel for connecting the inner mandrel to a wellhead sealing member;

a tubular outer mandrel telescopically receiving the inner mandrel in a surrounding relationship, wherein the outer mandrel carries at least one centralizer sub member;

a tubular backoff sub member having a lower end configured for threadable engagement with the bottom sub member and an upper part configured for threadable engagement with the outer mandrel; and a rotation lug insert mounted in a surrounding relationship over the internal mandrel, the rotation lug insert forms a lug engagement area between the rotation lug insert and the internal mandrel for backing off the internal mandrel.

12. A multi-gage blowout preventer test joint assembly for testing different size ram and annular subsea blowout preventers in one trip into a wellbore, comprising:

a tubular inner mandrel;

a bottom sub member securable to a bottom end of the inner mandrel for connecting the inner mandrel to a wellhead sealing member, the bottom sub member comprising a reduced diameter opening formed below the upper portion;

a tubular outer mandrel telescopically receiving the inner mandrel in a surrounding relationship;

a tubular backoff sub member having a lower end configured for threadable engagement with the bottom sub member and an upper part configured for threadable engagement with the outer mandrel;

a bullnose member detachably engageable with a bottom of the internal mandrel and configured to seal against the bottom sub member when the internal mandrel is engaged with bottom sub member; and a rotation lug insert mounted in a surrounding relationship over the internal mandrel, the rotation lug insert forms a lug engagement area between the rotation lug insert and the internal mandrel for backing off the internal mandrel.

13. The assembly of claim 12, wherein the bottom sub member comprises a hollow upper portion with internal threads, said upper portion being configured to threadably engage an externally threaded lower end of the backoff sub member.

14. The assembly of claim 13, wherein the reduced diameter opening is provided with internal threads along at least a portion thereof, and wherein the internal mandrel is threadably engaged therewith during a blowout preventer testing procedure.

15. The assembly of claim 14, wherein a test weep hole is formed in the upper portion of the bottom sub member, the weep hole extending transversely to a longitudinal axis of the bottom sub member, the weep hole allowing test fluid to run out of the bottom sub member as the test joint assembly is pulled out of the wellbore.

16. The assembly of claim 14, wherein the upper portion of the bottom sub member has an outwardly flaring inner wall configured to frictionally receive the lower end of the backoff sub member.

17. The assembly of claim 12, comprising a split ring fitted between an exterior of the outer mandrel and the backoff sub member and an anti-backoff ring positioned in a surrounding relationship over a segment of the outer mandrel above the split ring.

18. The assembly of claim 12, wherein the outer mandrel carries at least one centralizer sub member.

19. The assembly of claim 12, wherein the backoff sub member is provided with an internal shoulder and wherein a bottom surface of the rotation lug insert rests on said internal shoulder.

20. The assembly of claim 19, wherein the internal mandrel is provided with a lug cutout, and wherein an upper surface of the rotation lug insert abuts said cutout.

21. The assembly of claim 20, wherein the lug cutout has an angled aspect preventing engagement of the rotation lug insert when the internal mandrel is rotated to the left, while allowing engagement of the rotation lug insert with the internal mandrel during a right-hand rotation of the internal mandrel when the internal mandrel is backed off.

22. The assembly of 12, wherein the outer mandrel has a central opening, the backoff sub member has a central opening co-axially aligned with the central opening of the outer mandrel, and wherein the outer mandrel and the backoff sub member form a continuous unit telescopically receiving the internal mandrel in the co-axially aligned central openings.

* * * * *